US008434187B2

(12) United States Patent
Weinberger et al.

(10) Patent No.: US 8,434,187 B2
(45) Date of Patent: May 7, 2013

(54) ICE SCRAPER

(75) Inventors: Marvin Weinberger, Havertown, PA (US); Tucker J. Marion, Holliston, MA (US)

(73) Assignee: MIW Associates, LLC, Havertown, PA (US)

( * ) Notice: Subject to any disclaimer, the term of this patent is extended or adjusted under 35 U.S.C. 154(b) by 265 days.

(21) Appl. No.: 12/872,211

(22) Filed: Aug. 31, 2010

(65) Prior Publication Data

US 2011/0131747 A1 Jun. 9, 2011

Related U.S. Application Data

(60) Provisional application No. 61/266,769, filed on Dec. 4, 2009.

(51) Int. Cl.
*A46B 9/04* (2006.01)
*A47L 13/02* (2006.01)

(52) U.S. Cl.
USPC ..... 15/111; 15/105; 15/236.02; 15/236.06; 15/236.08; 30/169; 30/172

(58) Field of Classification Search ..... 15/105, 15/106, 111, 93, 114, 143.1, 236.01–236.09; 30/169, 172
See application file for complete search history.

(56) References Cited

U.S. PATENT DOCUMENTS

| | | | |
|---|---|---|---|
| 401,442 | A | 4/1889 | Lefebure |
| 1,377,484 | A | 5/1921 | Huneryager |
| 1,641,522 | A | 9/1927 | Beckord |
| 2,036,449 | A | 4/1936 | Weatherhead |
| 2,299,089 | A | 10/1942 | Haan |
| 2,532,429 | A | 12/1950 | Sparkman |
| 3,133,301 | A | 5/1964 | Helminen |
| 3,274,684 | A | 9/1966 | Marks |
| D207,256 | S | 3/1967 | Rippl |
| 3,848,289 | A | 11/1974 | Bachmann |
| 3,981,106 | A | 9/1976 | Gallo |
| 4,091,579 | A | 5/1978 | Giangiulio |
| 4,146,943 | A | 4/1979 | Wertheimer et al. |
| 4,164,801 | A | 8/1979 | Thomas |
| 4,255,880 | A | 3/1981 | McMickle et al. |
| 4,275,476 | A | 6/1981 | Hopkins et al. |
| 4,281,433 | A | 8/1981 | Sendoykas |
| 4,364,145 | A | 12/1982 | Jones et al. |
| 4,418,439 | A | 12/1983 | Porchet |
| 4,422,206 | A | 12/1983 | Brace et al. |
| 4,712,269 | A | 12/1987 | Worthen |
| D309,206 | S | 7/1990 | Kelley |
| 5,101,529 | A | 4/1992 | Tippie |
| 5,179,754 | A | 1/1993 | Stradnick |
| 5,435,064 | A | 7/1995 | Brookfield |
| D365,180 | S | 12/1995 | Brookfield |

(Continued)

OTHER PUBLICATIONS

Co-pending U.S. Appl. No. 12/408,403, filed Mar. 20, 2009.

(Continued)

*Primary Examiner* — Basil Katcheves
*Assistant Examiner* — Beth Stephan
(74) *Attorney, Agent, or Firm* — Duane Morris LLP

(57) ABSTRACT

A hand held scraper tool adapted to remove debris from a surface. The scrapper tool includes a body, handle and a plurality of abraders. At least one of the abraders can be configured as a highly flexible cantilever structure.

21 Claims, 10 Drawing Sheets

U.S. PATENT DOCUMENTS

| | | | | |
|---|---|---|---|---|
| 5,471,698 | A | 12/1995 | Francis et al. | |
| 5,680,668 | A | 10/1997 | Kim | |
| 5,758,983 | A | 6/1998 | Thomas | |
| 5,781,957 | A | 7/1998 | Scholl | |
| 5,806,134 | A | 9/1998 | Merrell | |
| 5,839,151 | A | 11/1998 | Whaley | |
| 5,908,255 | A | 6/1999 | Branch | |
| 5,915,794 | A | 6/1999 | Neff | |
| 5,983,504 | A | 11/1999 | Tisbo et al. | |
| 6,018,836 | A | 2/2000 | Williams | |
| 6,216,306 | B1 | 4/2001 | Esterson et al. | |
| 6,243,906 | B1 | 6/2001 | Holliday et al. | |
| 6,282,742 | B1 | 9/2001 | Boggs | |
| D460,589 | S | 7/2002 | Weinberger et al. | |
| 6,629,331 | B2 | 10/2003 | Panfili | |
| D499,852 | S | 12/2004 | Trunecek | |
| 7,249,393 | B2 | 7/2007 | Marion et al. | |
| 7,370,384 | B2 | 5/2008 | Miller et al. | |
| 7,526,831 | B2 | 5/2009 | Weinberger et al. | |
| 7,909,526 | B2 * | 3/2011 | Wales | 401/39 |
| 2003/0146632 | A1 | 8/2003 | Marion et al. | |
| 2005/0172442 | A1 | 8/2005 | Trunecek | |
| 2005/0210616 | A1 | 9/2005 | Santefort | |
| 2007/0199167 | A1 * | 8/2007 | Mason | 15/105 |
| 2008/0174165 | A1 * | 7/2008 | Russell | 300/21 |
| 2009/0313777 | A1 * | 12/2009 | Boyd et al. | 15/111 |
| 2010/0186183 | A1 | 7/2010 | Weinberger et al. | |

OTHER PUBLICATIONS

International Search Report dated Jul. 30, 2010 from corresponding PCT/US2010/021846 filed Jan. 22, 2010.

Co-pending U.S. Appl. No. 12/692,436, filed Jan. 22, 2010.

* cited by examiner

ICE SCRAPER

This application is a non-provisional of and claims benefit of priority to U.S. Provisional Patent Application No. 61/266,769, filed Dec. 4, 2009, herein incorporated by reference in its entirety.

BACKGROUND OF THE INVENTION

1. Field of the Invention

The present invention relates to the field of hand held scraping tools for removing debris from a surface. In an exemplary embodiment, the invention can be particularly effective for removing frost, snow, and/or ice from a curved or multi-planer surface.

2. Description of the Related Technology

Conventional ice scrapers generally have inadequate abrasive surfaces and poor flexibility to enable efficient removal of ice, snow and frost, particularly from curved surfaces such as the window shields of automobiles. Typically, these ice scrapers have an elongated handle attached to a blade with a continuous blade edge for scraping a surface. Upon applying force to the handle, the blade is pushed across a surface while the blade edge burrows into the ice and deflects ice away from the blade edge. The blade edge is generally the sole abrasive feature of the ice scraper and only enables scraping in one direction.

Additionally, conventional ice scrapers also lack flexibility. The rigid body and rigid blade structure of these ice scrapers are designed to apply a concentrated force to a surface in order to dislodge and deflect ice. The rigidity of conventional ice scrapers, however, also prevents the blade and blade edge from conforming to curved or multi-planer surfaces. Consequently, traditional ice scrapers are unable to effectively remove ice, snow or frost from curved surfaces, such as the window shield of a vehicle, or multi-planer surfaces, such as the headlights and surrounding frame of a vehicle.

Furthermore, the elongated narrow handle of conventional ice scrapers requires a user expend an excessive amount of force in order to scrape away ice adhering to a surface. The handles are neither ergonomic nor do they effectively transfer the applied force to a surface to be cleaned.

In view of the aforementioned limitations of the prior art, there exists a need to develop an improved ice scraper with a flexible blade capable of more effectively removing debris from a surface.

SUMMARY OF THE INVENTION

The invention is directed to a hand held scraper for removing debris from a surface. The scraper includes a body, a handle attached to the body, and a plurality of cantilever abraders that are flexible and capable of independently moving relative to one another. Each of the cantilever abraders includes a cantilever body hinged to the body of the hand held scraper, wherein the cantilever body includes a scraping edge positioned on an end of the cantilever body for scraping a surface, wherein the scraping edge of at least one cantilever abrader overlaps with an adjacent cantilever abrader scraping edge so as to substantially prevent passage of debris therebetween.

In another aspect of the invention, the hand held scraper includes a body, a handle attached to the body, and a plurality of cantilever abraders that are flexible and capable of independently moving relative to one another. At least one of the cantilever abraders includes a cantilever body hinged the body of the hand held scraper, wherein the cantilever body has a scraping member including a scraping edge positioned on the end of the cantilever body for scraping a surface and two support flanges connected to the scraping member that reinforce the scraping edge.

BRIEF DESCRIPTION OF THE DRAWINGS

FIG. 1(*b*) is a bottom perspective view of the scraper tool of FIG. 1(*a*).

FIG. 5(*b*) is a perspective front view of the scraper tool of FIG. 5(*a*).

FIG. 5(*c*) is a perspective elevated side view of the scraper tool of FIG. 5(*a*).

FIG. 5(*d*) is a perspective bottom view of the scraper tool of FIG. 5(*a*).

FIG. 5(*e*) is another perspective bottom view of the scraper tool of FIG. 5(*a*).

FIG. 7(*b*) is a schematic diagram showing a bottom view of two rows of bristles arranged in a staggered configuration.

FIG. 7(*c*) is a schematic diagram showing different possible cross-section configurations of exemplary bristles.

DETAILED DESCRIPTION OF THE PREFERRED EMBODIMENT(S)

Figure 1A:
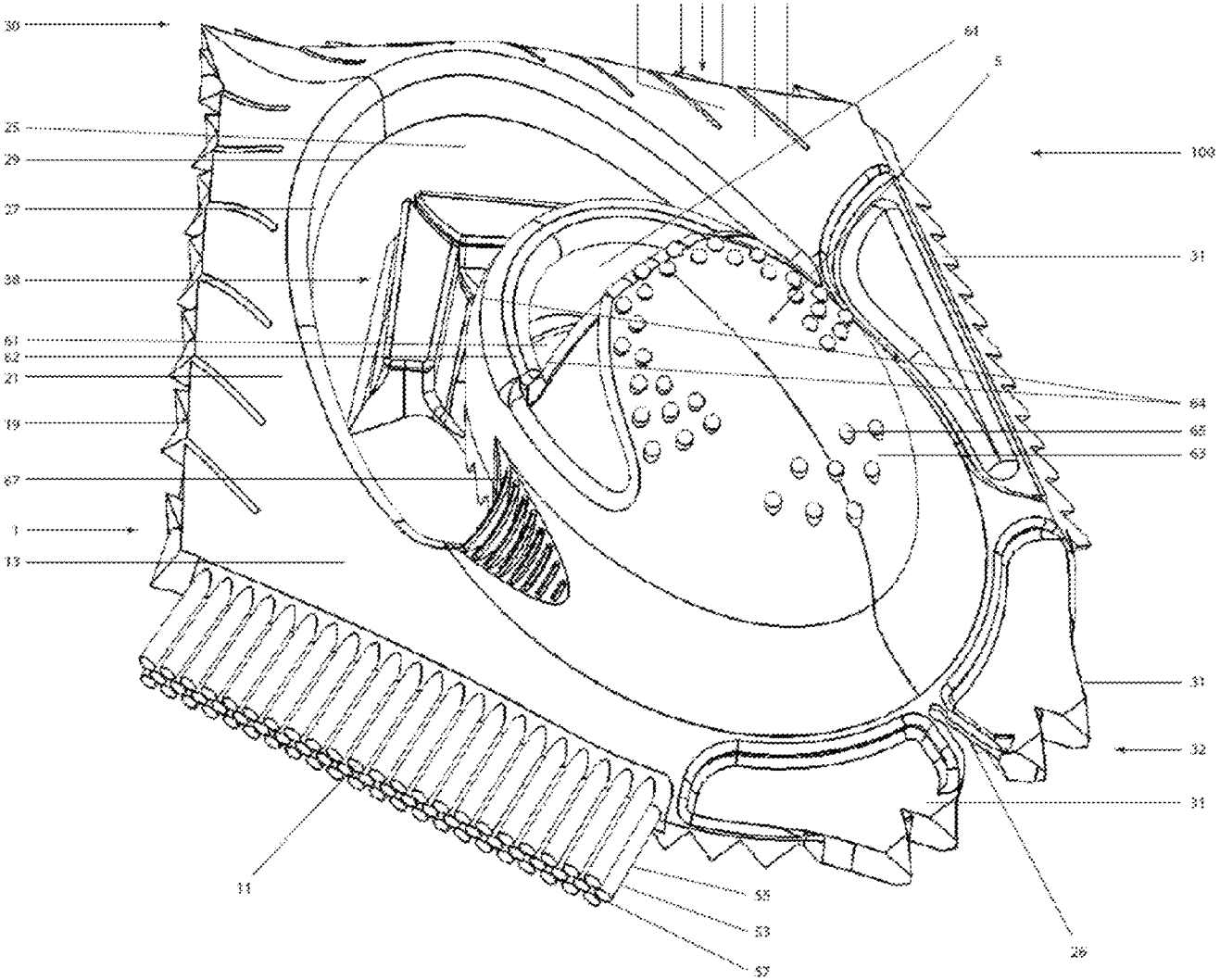
FIG. 1(*a*) is a top perspective view of a first scraper tool embodiment of the present invention.

For illustrative purposes, the principles of the present invention are described by referencing various exemplary embodiments thereof. Although certain embodiments of the invention are specifically described herein, one of ordinary skill in the art will readily recognize that the same principles are equally applicable to, and can be employed in other apparatuses and methods. Before explaining the disclosed embodiments of the present invention in detail, it is to be understood that the invention is not limited in its application to the details of any particular embodiment shown. The terminology used herein is for the purpose of description and not of limitation. Further, although certain methods are described with reference to certain steps that are presented herein in certain order, in many instances, these steps can be performed in any order as may be appreciated by one skilled in the art, and the methods are not limited to the particular arrangement of steps disclosed herein.

It must be noted that as used herein and in the appended claims, the singular forms "a", "an", and "the" include plural references unless the context clearly dictates otherwise. Thus, for example, reference to "an abrasive element" includes a plurality of abrasive elements and equivalents thereof known to those skilled in the art, and so forth. As well, the terms "a" (or "an"), "one or more" and "at least one" can be used interchangeably herein. It is also to be noted that the terms "comprising", "including", and "having" can be used interchangeably.

Furthermore, unless otherwise defined, all technical and scientific terms used herein have the same meaning as commonly understood by one of ordinary skill in the art to which this invention belongs. Although any methods and materials similar or equivalent to those described herein can be used in the practice or testing of the present invention, the preferred methods and materials are now described.

As used herein, the term "abrasive elements" may include any abrasive structure designed to cut, scrape or otherwise induce wear. Exemplary abrasive elements include, but are not limited to, protrusions, teeth, serrations, ridges, barbs, spikes, hooks, rasps, graters or any combination thereof.

Additionally, for purposes of the present application, the term "debris" as used herein may refer to any undesirable material that is positioned on or adhered to a surface. In an exemplary embodiment, debris can include frost, snow, ice, food substances, adhesives, paint, or combinations thereof.

The present invention is directed to a novel hand held scraper tool and method for use thereof. The technology may be predicated upon the importance of enhancing the ability to efficiently and effectively remove debris by: providing a plurality of abraders customized for different applications, providing flexible abraders capable of conforming to curved and multi-planer surfaces, providing a shield to deflect debris loosened by the abraders, and providing an ergonomic handle that efficiently transfers manually applied force to the abraders. Scraper tool 100 includes a body 1, handle 5, one or more fixed abraders that are integrally formed with or otherwise mounted to body 1 so as to be substantially immobile relative to body 1, one or more movable abraders that are capable of moving relative to body 1, one or more brushes 11, or combinations thereof.

Figure 1B:
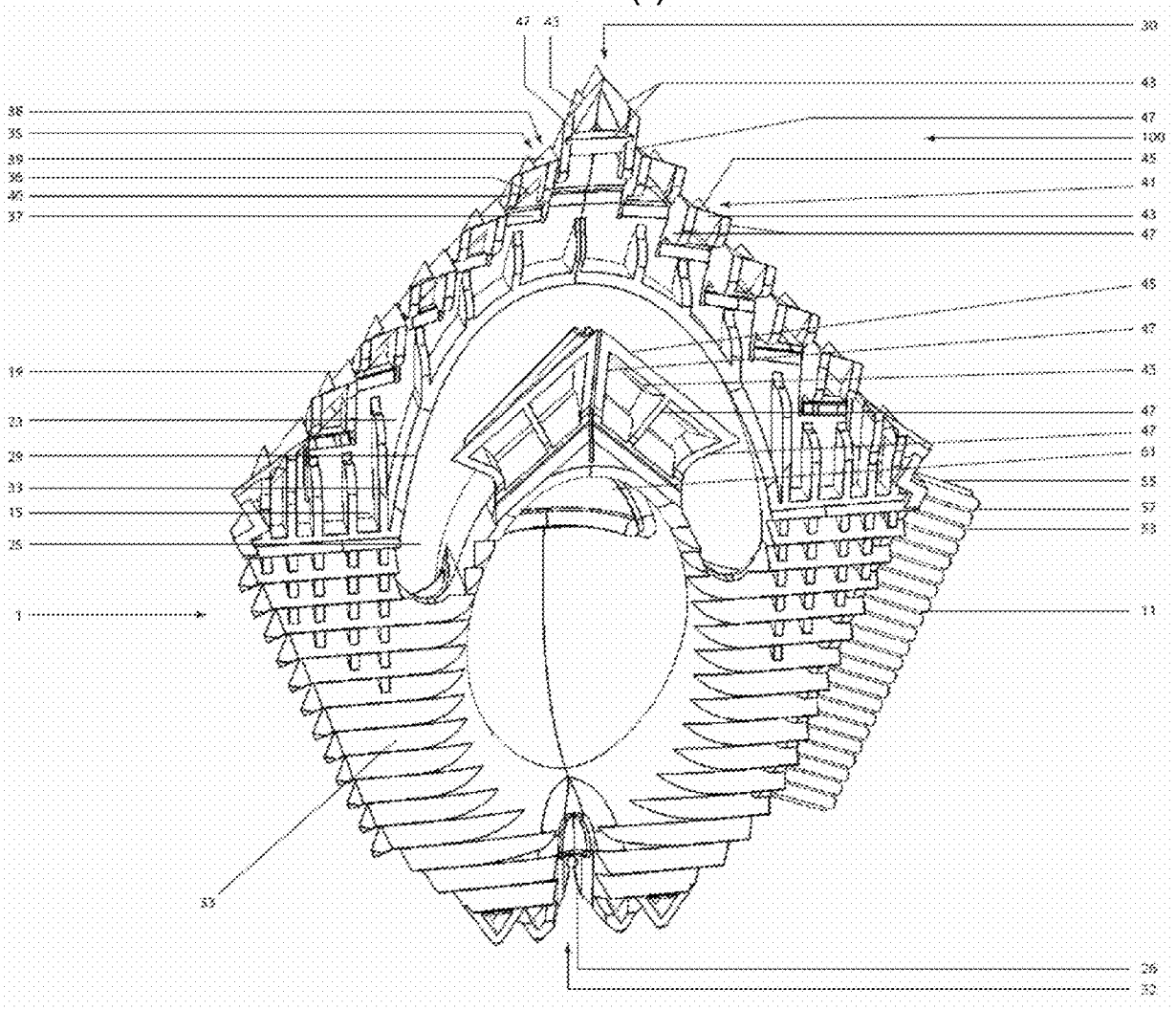

Referring now to the drawings, wherein like reference numerals designate corresponding structure throughout the views, the exemplary embodiment of FIGS. 1(*a*)-1(*b*) shows an scraper tool 100 including a body 1 that can have any shape, dimension, and configuration suitable to enable scraping and debris removal. As shown, body 1 has a portable, light weight, and compact configuration that can be easily operated using one hand. Body 1 can be constructed from any material, including plastics, metals, ceramics or combinations thereof. Exemplary materials include polycarbonate alloys.

As shown in FIGS. 1(*a*)-1(*b*), body 1 has an upper surface 13, a lower surface 15, and an outer perimeter defined by one or more outer edges 19. The outer perimeter can be substantially circular, elliptical, or otherwise curved. Alternatively, the outer perimeter can be defined by a plurality of linear edges, having a shape such as a rectangle, pentagram, or hexagram. The perimeter can also be configured to have a combination of linear and curved outer edges 19. Body 1 can further include one or more elevated regions 21, wherein a portion of the upper surface 13 is elevated relative to an adjacent outer edge 19 and/or adjacent upper surface 13 regions, creating a raised structure. A corresponding space 23 can be defined by a raised lower surface 15 corresponding to elevated region 21, wherein space 23 can be defined by an elevated region of lower surface 15 that is raised relative to adjacent lower surface regions and/or adjacent outer edge 19. In an exemplary embodiment, elevated region 21 has a sloped configuration that substantially spans the width of the scraper tool and defines a corresponding cavity or concave region of lower surface 15.

Body 1 further includes one or more interior regions 25 that are enclosed by and spaced apart from one or more outer edges 19. As shown in FIGS. 1(*a*)-1(*b*), interior region 25 is a space defined and bound in part by an interior wall 27 terminating in an interior edge 29 and a portion of handle 5. As shown, interior region 25 can be configured as a crescent or half circle shaped through hole having a length or diameter of about 3 inches to about 4 inches that extends through scraper tool 100. The through hole can facilitate the removal of debris that has accumulated beneath scraper tool 100. Optionally, one or more fixed abraders, movable abraders, and/or brushes 11 can be positioned along a portion of interior wall 27, interior edge 29, handle 5, a perimeter of interior region 25, or combinations thereof to further increase the abrasive surface area of scraper tool 100.

In an exemplary embodiment, interior wall 27 can be configured as a shield for deflecting debris away from a user's hand, wherein interior wall 27 extends substantially downwards so as to enable interior edge 29 to contact a surface to be cleaned and/or deflect debris accumulated beneath the scraper tool 100 away from handle 5. Additionally, interior wall 27 can extend substantially upwards so as to deflect debris that accumulates on upper surface 13 away from handle 5. The surface of interior wall 27 can be angled or pitched to facilitate deflection of debris away from handle 5. For example, interior wall 27 can be angled so as to extend down towards either the front 30 or back 32 of scraper tool 100. In one embodiment, interior wall 27 can have a sloped surface, wherein interior edge 29 is positioned closer to handle 5 than an upper edge of interior wall 27 adjoining upper surface 13 so as to direct debris up interior wall 27 and over upper surface 13. Alternatively, interior wall 27 can be substantially perpendicular to an adjacent upper surface 13.

In an exemplary embodiment, body 1 further includes a notch 26 that is sized and configured to receive, conform to, and clean a windshield wiper blade of a vehicle. As shown in FIGS. 1(*a*)-1(*b*), notch 26 has a narrow distal end that gradually widens as it extends away from the body of scraper tool 100. The distal end can have a semi-circular or triangular shape suitable for cleaning the edge of a wiper blade, and the overall configuration of notch 26 may have a triangular configuration. In one embodiment, the length of notch 26 may be about 0.5 inches to about 3 inches, preferably about 0.5 inches to about 2 inches. Optionally, the perimeter of notch 26 includes one or more abrasive elements that would further facilitate cleaning a wiper blade. Notch 26 can be positioned any where along outer edge 19 or a side of body 1. As shown in FIG. 1(*a*), notch 26 can be positioned at the back 32 of scraper tool 100 between two scraper blades 31. In operation, a user can insert the blade or the entire width of windshield wiper blade into notch 26. By moving scraper tool 100, notch 26 can be drawn along the length of the wiper blade.

As shown in FIGS. 1(*a*)-1(*b*), a plurality of fixed abraders, such as scraper blades 31 and scraper projection 33, can be integrally fabricated with or otherwise mounted to body 1 of scraper tool 100. Scraper blades 31 and scraper projections 33 may be either flexible or rigid structures. Preferably, scraper blade 31 and scraper projections 33 have a rigid structure designed to remove hardened or entrained debris.

As shown in FIG. 1(*a*), scraper blade 31 can be any conventional scraper blade having an edge designed to enable scraping, cutting, and/or any abrasive action. The edge of scraper blade 31 can be configured as a linear blade edge or can include a plurality of abrasive elements. Scraper blade 31 can be integrally fabricated with, removably mounted to, permanently mounted to, and/or otherwise extend out from a portion of outer edge 19, interior edge 29, upper surface 13, lower surface 15, side of body 1 or any combination thereof. As shown in FIG. 1(*a*), one scraper blade 31 is mounted to a side outer edge 19, and two other scraper blades 31 are mound to and extend from the rear of body 1. In an exemplary embodiment, scraper blade 31 is contoured to facilitate removal of hard debris, such as ice, from a vehicle's headlights, side view minors, and/or window shield.

As shown in FIG. 1(*b*), scraper tool 100 can further include a plurality of scraper projections 33 that are integrally fabricated with, otherwise mounted to, and/or extend from a lower surface 15 of body 1. Scraper projection 33 can have any size, shape or configuration suitable for scoring, breaking, and/or scraping debris. Preferably, scraper projection 33 has a distal linear blade edge or can include a plurality of abrasive elements for removing debris. The length, width, height, and/or configuration of one or more scraper projections 33 can vary relative to other scraper projections 33 in order to facilitate the removal of different types of debris. In one embodiment, the height of one or more sets of scraper projections 33 can be graduated. In addition to using scraper projection 33 to apply a shear force along a surface, scraper projection 33 can also be used to pound a surface in order to break-up or loosen adhered debris. In an exemplary embodiment, scraper projection 33 can be configured as ridges or teeth like structures. The distal end and sides surfaces of scraper projection 33 can optionally include a plurality of abrasive elements to further facilitate debris removal. As shown in FIG. 1(*b*), scraper projection 33 is substantially parallel and/or substantially perpendicularly aligned relative to the front 30 of scraper tool 100. One or more portions of scraper projection 33 intersect and/or overlap with adjacent scraper projection 33 in a substantially perpendicularly arrangement. In an alternative embodiment, scraper projection 33 can be arranged in a plurality of different orientations, pointing in a plurality of different directions. For example, one or more scraper projections 33 can be oriented substantially parallel to and/or substantially perpendicular to each outer edge 19 of scraper tool 100. Alternatively, one or more scraper projections 33 can be oriented at an acute or obtuse angle relative to one or more outer edges 19. Additionally, scraper projection 33 can intersect and/or overlap with one another at any angle. In another embodiment, scraper projections 33 can be arranged in rows and/or columns. Alternatively, scraper projections 33 can have a staggered configuration. As shown in FIG. 1(*b*) scraper projections 33 can cover a substantial portion of lower surface 15. Preferably, scraper projections 33 can cover an entire rear and/or middle region of lower surface 15.

Scraper tool 100 further includes one or more movable abraders that are capable of moving relative to body 1. As shown in FIGS. 1(*a*)-1(*b*), the movable abraders can be configured as cantilever abraders 38. The cantilever abraders 38 have a cantilever structure/body 35 that includes an upper cantilever body surface 34, lower cantilever body surface 36, distal end 39, sides 40 and a proximal end 37 that is integral with or otherwise hinged to body 1. Preferably, the cantilever abraders 38 extend from elevated region 21 of body 1 to allow for greater vertical displacement of the cantilever abraders 38. Optionally, one or more scraping structures 41 project from a lower cantilever body surface 36 and function to fracture hard debris, such as ice, as well as remove debris. Scraping structures 41 can be integrally fabricated with or otherwise mounted to any portion of cantilever body 35, including a distal end 39, proximal end 37, side 40, middle region, and/or combinations thereof. In an exemplary embodiment, a score line, such as a shallow indentation line, can be arranged on the upper cantilever body surface 34 and/or lower cantilever body surface 36 adjacent to scraping structure 41 and proximal end 37 to further enable bending and increase the flexibility of scraping structure 41 of cantilever abrader 38. Each scraping structure 41 can include one or more scraping members 43 and one or more support flanges 47. In one embodiment, scraping structure 41, one or more scraping member 43, one or more support flange 47 or combinations thereof can have a substantially rigid or flexible configuration.

As shown in FIG. 1(*b*), each scraping member 43 includes a scraping edge 45. In an exemplary embodiment, scraping member 43 can be configured as a scraping blade, and scraping member edge 45 can be configured as a blade edge suitable for cutting, scraping or otherwise abrading a surface. Scraping member edge 45 can be a continuous linear or curved edge. In an alternative embodiment, scraping member edge 45 can have a contoured edge including a plurality of abrasive elements.

Scraping edge 45 and scraping member 43 are connected to two support flanges 47 projecting from a lower cantilever body surface 36 that functions to stabilize and/or reinforce scraping member 43 and scraping edge 45. Support flanges 47 may have any suitable size, dimensions or configuration. In the embodiment of FIG. 1(*b*), support flange 47 is a planar structure having a triangular configuration with a wide base that tapers to a point as it extends away from lower cantilever body surface 36. Support flanges 47 can also have one or more substantially sharpened edges suitable to facilitate scraping. One or more abrasive elements can be positioned on any surface of scraping members 43 and/or support flange 47, including a front, back, side, or distal tip thereof.

As shown in FIG. 1(*b*), the cantilever abrader 38 positioned at the front 30 of scraper tool 100 has a scraping structure 41 including three scraping members 43 arranged in a triangular configuration. The pointed configuration of this cantilever abrader 38 provides a concentrated forward force that facilitates scraping. Adjacent cantilever abraders 38 include one scraping member 43 positioned substantially perpendicularly between two support flanges 47. Two optional cantilever abraders 38, each having a scraping member 43 and three support flanges 47 are integrally formed along a portion of handle 5. These three support flanges 47, as shown in FIG. 1(*b*), extend down and substantially contact a surface to be cleaned and can function in essentially the same manner as scraping member 43 and/or scraper projection 33.

Figure 2:
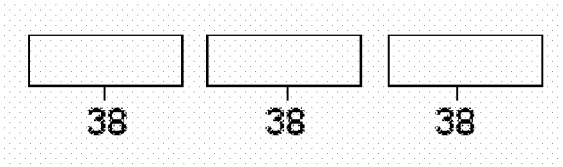
FIG. 2 is a schematic diagram showing the cantilever abraders arranged in a linear horizontal row.
Figure 3:
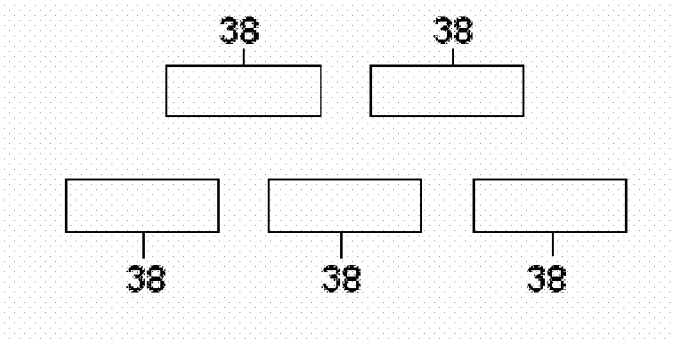
FIG. 3 is a schematic diagram showing the cantilever abraders arranged in two rows having a staggered configuration.
Figure 4:
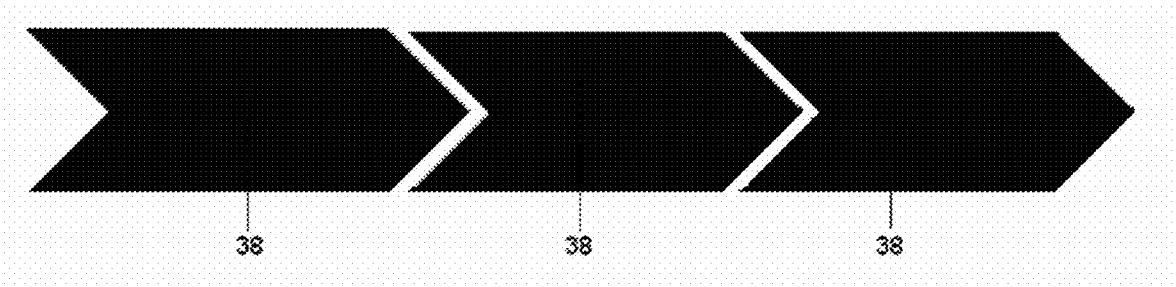
FIG. 4 is a schematic diagram of showing the cantilever abraders arranged in a row having a nested configuration.
Figure 5A:
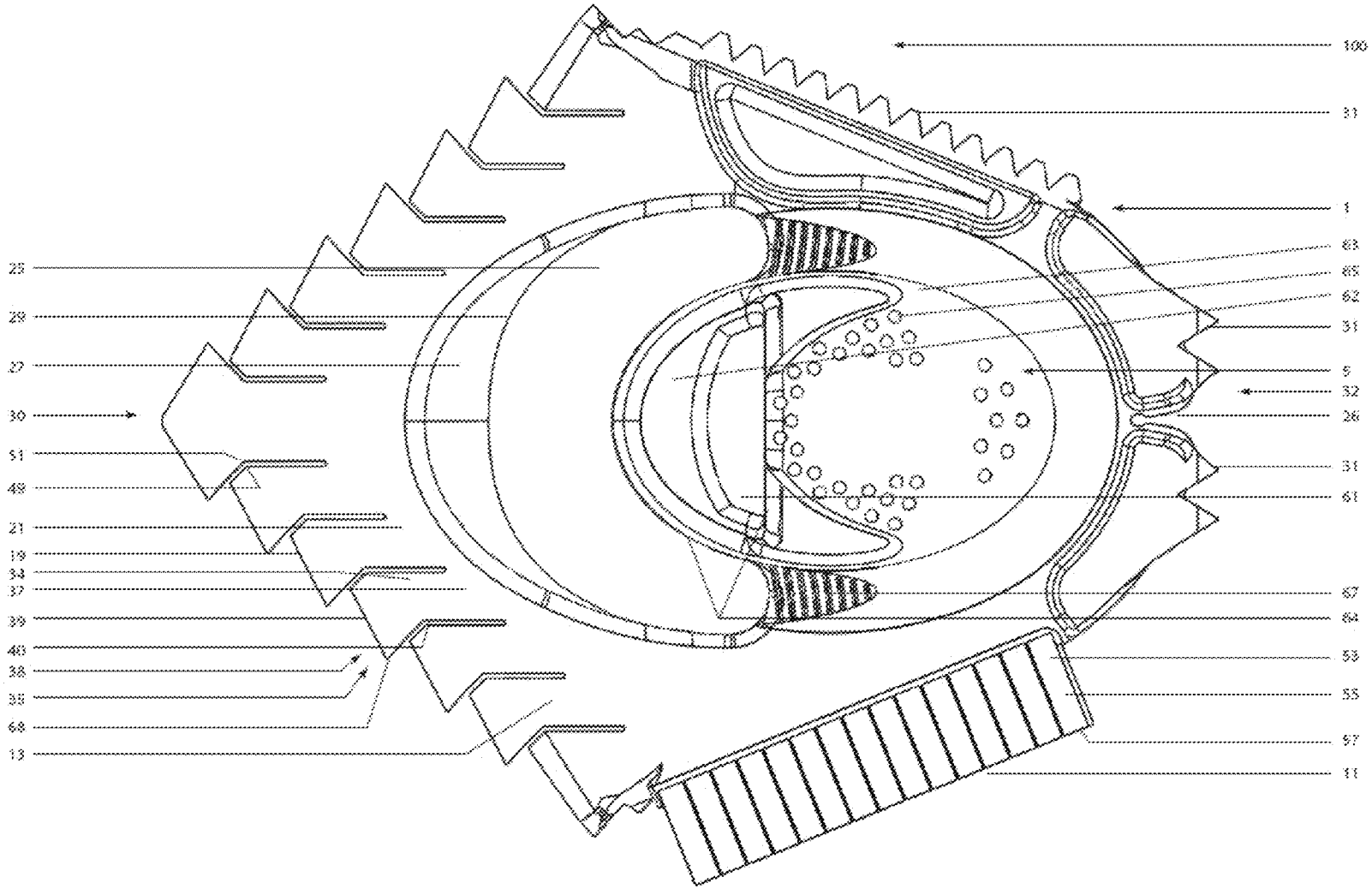
FIG. 5(*a*) is a perspective top view of a second scraper tool embodiment of the present invention.
Figure 5B:
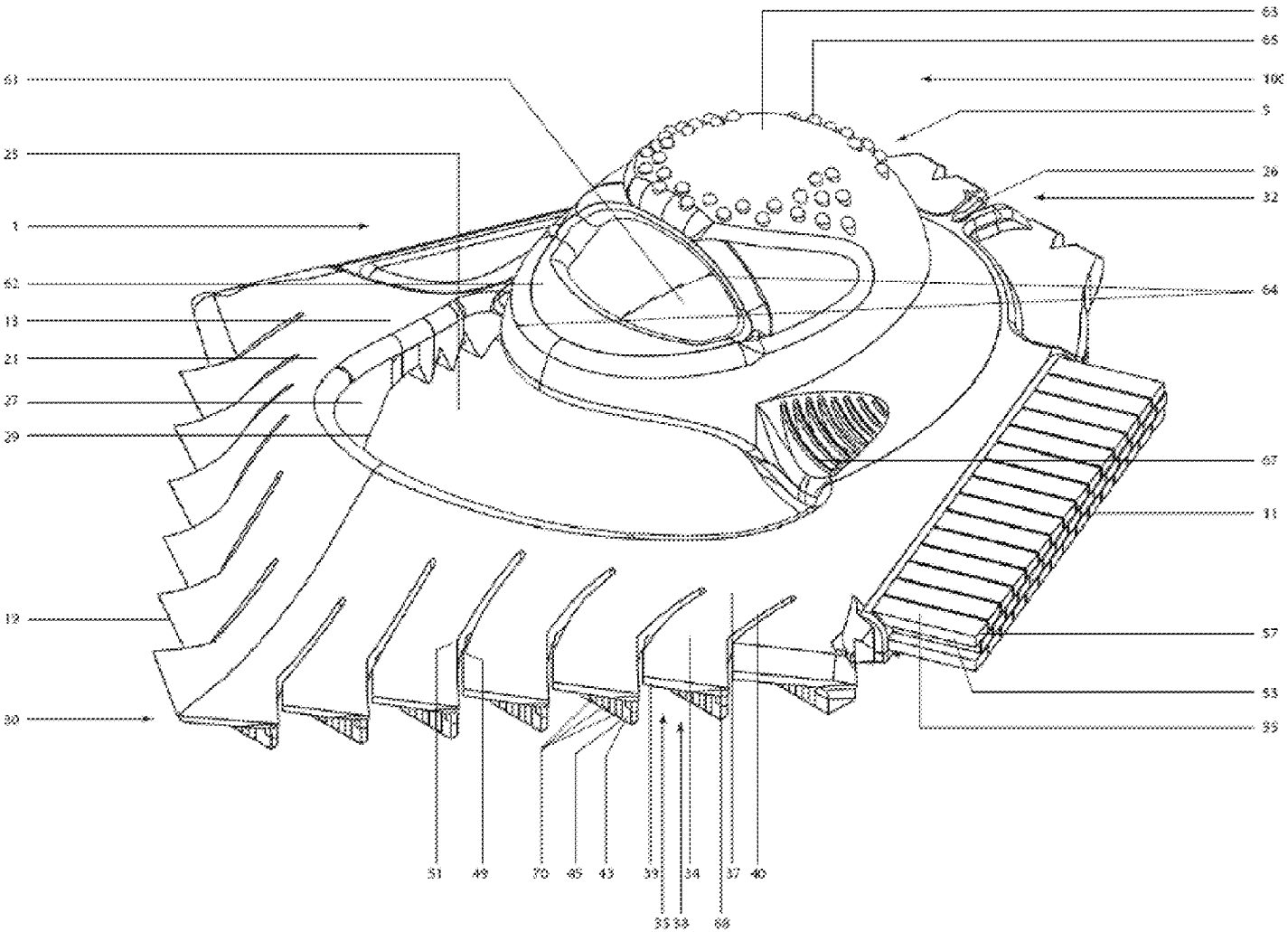
Figure 5C:
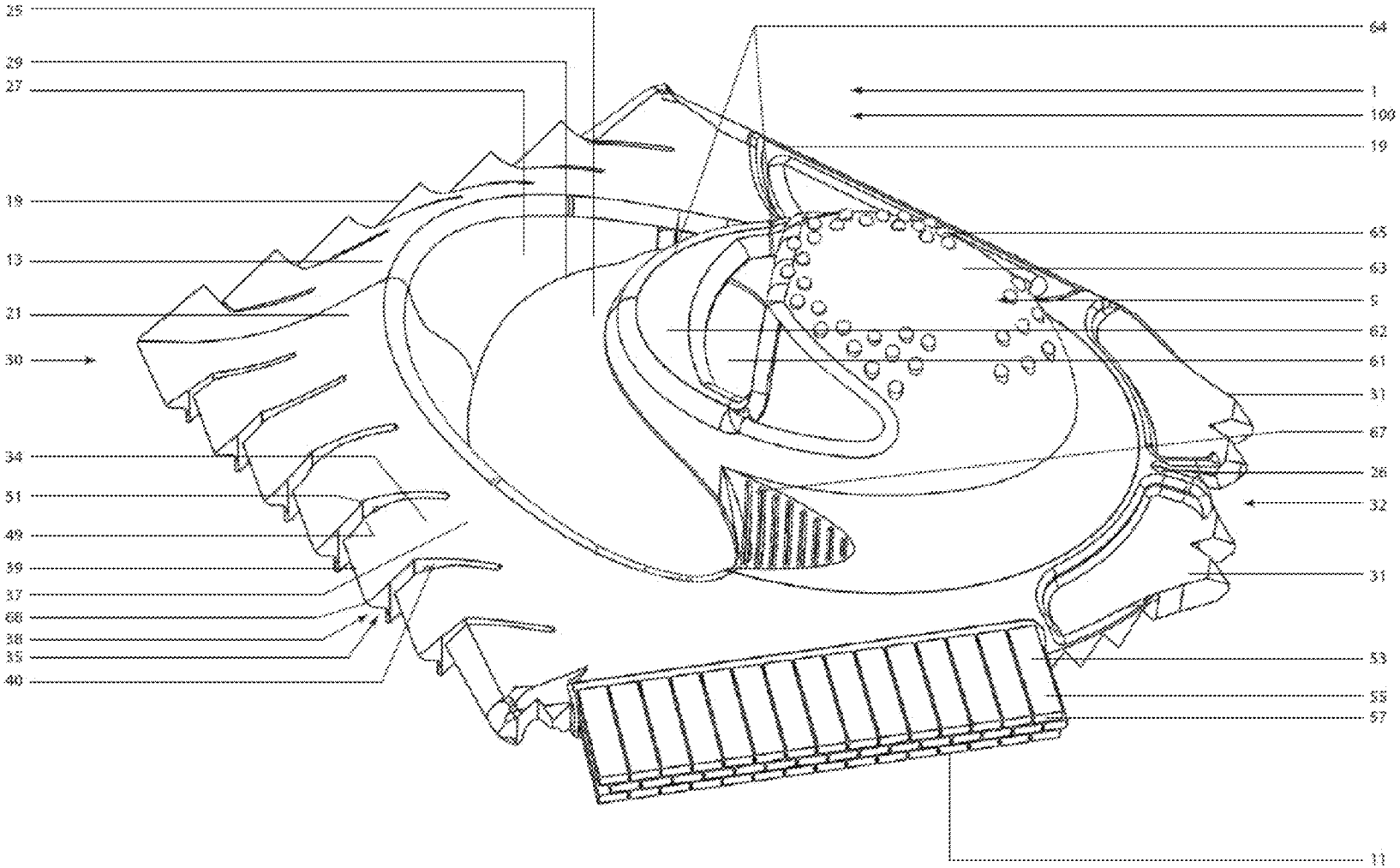
Figure 5D:
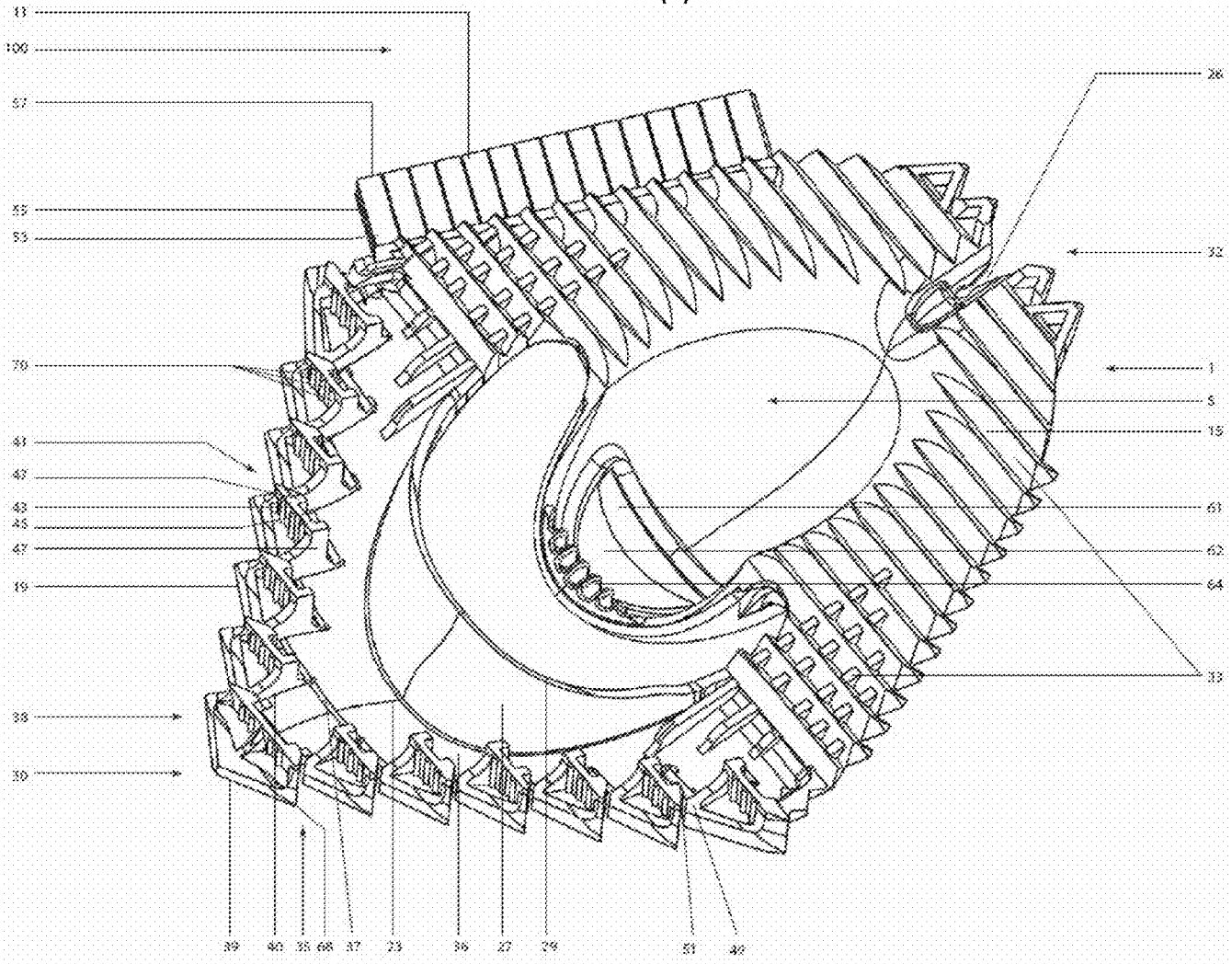
Figure 5E:
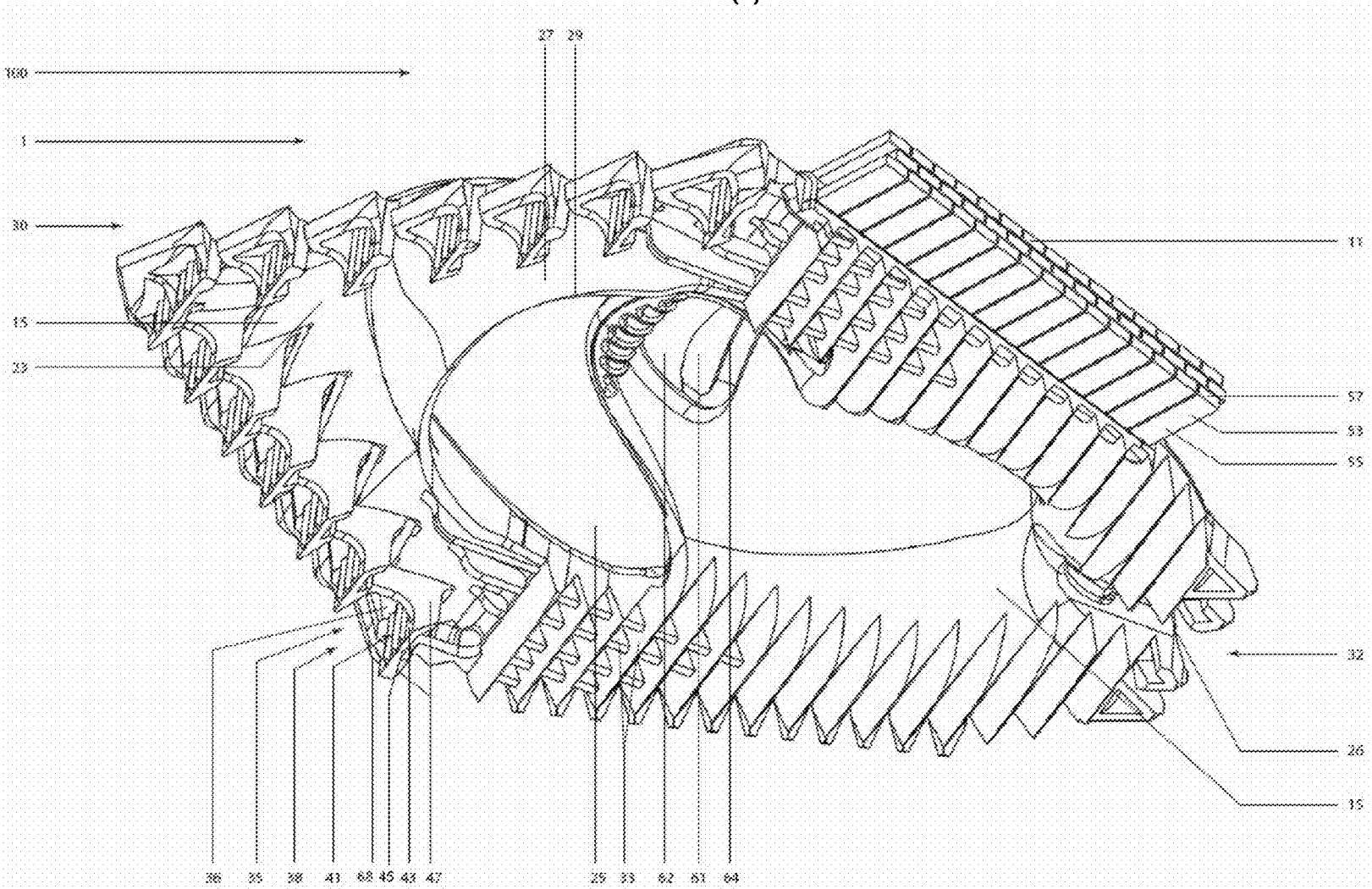

As shown in FIG. 1(*b*), cantilever abraders 38 are arranged adjacent to one another forming the substantially arrow shaped perimeter of body 1, wherein the scraping member edges 45 of the cantilever abraders 38 can be substantially positioned adjacent to one another in a diagonal configuration. The cantilever abraders 38 may also be positioned in alternative arrangements, such as a linear row as shown in FIG. 2, a curved configuration or a staggered configuration as shown in FIG. 3. Preferably, adjacent cantilever abraders 38 are positioned relative to one another in a nested arrangement, as shown in FIG. 4. In the aforementioned arrangements, the cantilever abraders 38 are arranged in a densely packed array, wherein the scraping member edge 45 of each cantilever abrader 38 is positioned substantially close to the scraping member edge 45 of an adjacent cantilever abrader, such that debris does not substantially pass between and accumulate between adjoining cantilever abraders 38. Similarly, the support flange 47 of each cantilever abrader 38 is positioned substantially close to the support flange 47 of an adjacent cantilever abrader, to substantially prevent passing of debris therebetween.

Another embodiment of cantilever abraders 38 is shown in the exemplary scraper tool embodiment of FIGS. 5(*a*)-5(*e*). As shown in FIGS. 5(*d*)-5(*e*), cantilever abrader 38 includes a scraping structure 41 having a scraping member 43 connected to and flanked by two support flanges 47. Scraping member 43 is configured as a substantially rectangular planar member having a scraping edge 45. Attached to opposite sides of scraping member 43 in a substantially perpendicular orientation are two support flanges 47, each having a proximal base end attached to lower cantilever abrader surface 36 that tapers to a distal edge that may be used for scraping and adjoins scraping edge 45. Additionally, an elongated tapered edge, preferably configured as a blade edge, formed where support flange 47 joins scraping member 43 can also be used as an abrasive scraping structure.

Figure 6:
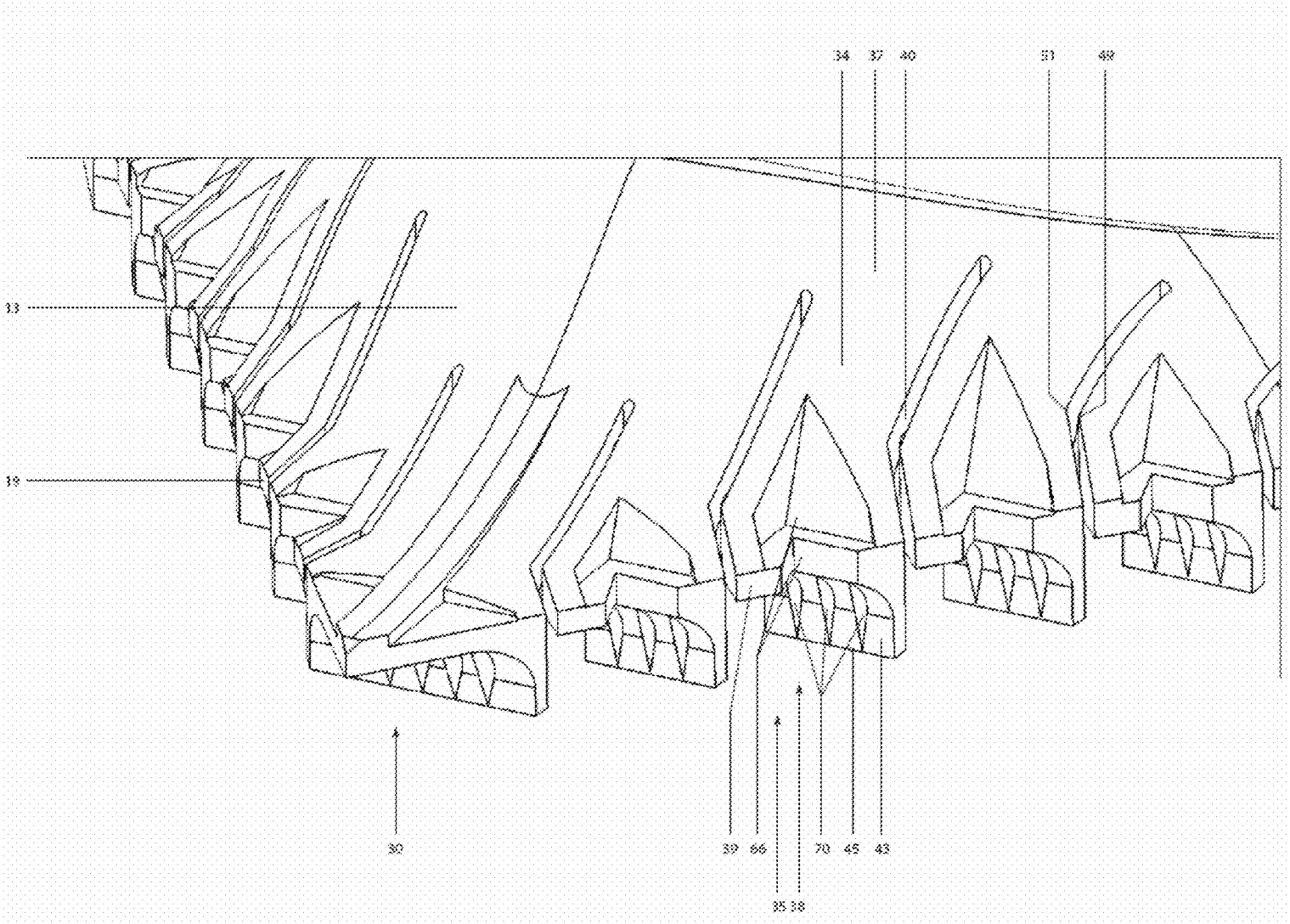
FIG. 6 is a perspective front view of another scraper tool embodiment showing an exemplary embodiment of the cantilever abraders.

To facilitate debris removal, a plurality of abrasive elements can be positioned on any surface of scraping member 43 and/or support flange 47, including the front, back, side or distal edge or point of scraping member 43 and/or support flange 47. As best shown in FIG. 5(*d*), a plurality of abrasive protrusions 70 are positioned on and attached to a front surface of scraping member 43, facing the front 30 of scraper tool 100. Abrasive protrusions 70 can be configured as any abrasive element and can have any suitable configuration for facilitating scraping and debris removal. In one embodiment, abrasive protrusions 70 may be configured as teeth like structures intermittently formed on scraping member 43. Preferably, abrasive protrusions 70 substantially cover the entire front surface of scraping member 43. In one embodiment, abrasive protrusions 70 contact scraping edge 45 or are connected thereto so as to form an extension of scraping edge 45. As shown in the exemplary embodiment of FIG. 5(*d*), abrasive protrusions 70 are configured as elongated cylindrical or pyramidal structures having a lower end that contacts scraping edge 45 and an upper end positioned substantially adjacent to an upper end of scraping member 43. The abrasive projections are arranged in a row along the front surface of scraping member 43 in order to facilitate scraping and breakup debris. In another embodiment, shown in FIG. 6, abrasive protrusions 70 may be configured as a plurality of triangular, wedge teeth arranged in row on the front, forward facing surface of scraping member 43.

Cantilever abrader 38 may be further configured and contoured to provide additional abrasive surfaces and features to facilitate debris removal. For example, as shown in FIGS. 5(*a*)-5(*c*), a distal end 39 or side 40 of cantilever body 35 can further have one or more protruding edges 68 that can be used to facilitate scraping. The distal end 39 of cantilever body 35 can further include two or more, preferably a plurality of recesses 66 bound by a plurality of sharpened edges that facilitate debris removal. For example, as shown in the exemplary cantilever abrader 38 embodiment of FIG. 6, distal cantilever body end 39 has two wedge like recesses 66 having sharpened edges that increase the abrasive surface area of scraper tool 100.

As shown in FIGS. 5(*a*)-5(*d*) and 6, the cantilever abraders 38 can be arranged in a nested configuration. As shown, a surface of cantilever body 35 has a configuration that corresponds to and fits with an adjacent cantilever body 35 of an adjoining cantilever abrader. An exemplary nesting configuration is shown in FIGS. 5(*a*)-5(*d*), wherein one cantilever abraders 38 has a protruding male cantilever body mating structure 49 and an adjoining cantilever abrader 38 includes a female cantilever body mating structure 51 having a corresponding recess. Notably, the nesting configuration does not restrain or otherwise inhibit the vertical range of motion of the individual cantilever abraders 38.

As shown in FIG. 5(*d*), the scraping member edges 45 of the cantilever abraders 38 can be substantially positioned adjacent to one another in a diagonal configuration. FIG. 5(*d*) further shows that a portion of scraping member edge 45 of cantilever abraders 38 can be arranged so as to be spaced apart and overlap with a portion of the scraping member edge 45 of an adjacent cantilever abrader 38, to substantially prevent debris from passing between and/or accumulate between adjoining cantilever abraders 38. Similarly, a portion of a support flange 47 of a cantilever abrader 38 can be aligned so as to be spaced apart and overlap with a portion of the support flange 47 of an adjacent cantilever abrader 38, to substantially prevent passing of debris therebetween. Alternatively, as shown in FIG. 3, the cantilever abraders 38 can form two or more staggered rows of cantilever abraders 38 that are spaced apart and overlap with one another. The cantilever abraders can also be fitted relative to one another so as to form a linear horizontal row, wherein corresponding male and female cantilever body mating structures 49, 51 create a nested configuration, as shown in FIG. 4.

The cantilever abraders 38 can be arranged in a densely packed array of highly flexible articulating abraders that are capable of independent movement relative to one another. The cantilever structure enables scraper tool 100 to conform to and enable effective removal of debris from a multi-planer surface. Upon applying a force to handle 5, one or more cantilever abraders 38 can be pressed against a surface to be cleaned. The cantilever abraders 38 will deflect upward due to the resistive pressure from the surface against which the cantilever abraders 38 are pressed. In an exemplary embodiment, the distal end 39 of one or more cantilever abrader bodies 35 is capable of vertical displacement over a range of about 0 inches to about 2 inches, preferably, about 0 inches to about 1 inches, more preferably, about 0 inches to about 1.5 inch, more preferably, about 0 inches to about 0.5 inch, and most preferably, about 0 inches to about 0.375 inches. To enable this vertical displacement, one or more cantilever abraders 38 is capable of angular movement about the point where the proximal end 37 of the cantilever body 35 is hinged to body 1 over a range of about 0 to about 90°, preferably, about 0 to about 60°, more preferably, about 0 to about 45°, more preferably, about 0 to about 30°, most preferably, about 0 to about 15°. In an exemplary embodiment, the cantilever abrader 38 can have a spring constant of about 2.2 kN/m to about 15 kN/m, preferably about 5 kN/m to about 15 kN/m. The range of motion of highly flexible cantilever abraders 38 is dependent upon the applied pressure and curvature of the surface to be scraped or cleaned. In addition to being highly flexible, cantilever abraders 38 are also designed to provide a sufficient amount of force to enable effective scraping. The cantilever abraders 38 also have a sufficient rigidity and strength to avoid permanent deformation and fatigue, particularly at the point where proximal end 37 of the cantilever body 35 is hinged to body 1 and/or the score line on the lower cantilever body surface 36 adjacent to scraping structure 41, even after extended use and repeated bending.

Preferably, as shown in FIGS. 1(*b*) and 5(*d*)-5(*e*), cantilever abraders 38 can be arranged relative to scraper projections 33 in any manner to substantially minimize or eliminate the gaps between adjoining cantilever abraders 38 so as to substantially prevent debris from passing between or accumulating between adjoining cantilever abraders 38. In an exemplary embodiment, at least one scraper projection 33 is spaced apart and positioned behind two adjoining cantilever abraders 38, wherein the scraper projection 33 is oriented so that the length of scraper projection 33 overlaps with at least a portion of the two adjoining cantilever abraders 38. Preferably, a plurality of cantilever abraders 38 can substantially cover and substantially occupy an entire front and/or middle region of lower surface 15. In an exemplary embodiment, cantilever abraders 38 and scraper projections 33 substantially covers and substantially occupies the entire lower surface 15 of scraper tool 100.

As shown in FIGS. 1(*a*)-1(*b*) and 5(*a*)-5(*e*), scraper tool 100 can further include one or more brushes 11 mounted to or integral with a surface of body 1, including outer surface 13, such as outer edge 19 or a side of body 1, and lower surface 15. Brush 11 can include a plurality of bristles 53 that collectively can be capable of functioning both as a conventional brush and as a squeegee. Bristles 53 can be independently moved relative to one another to facilitate cleaning of multi-planar surfaces. Bristles 53 can have a wide range of motion and can move bi-directionally. In one embodiment, bristles 53 can be capable of independently bending and flexing in three dimensions over an angle. Bristles 53 can further be closely oriented relative to one another so as to be capable of creating a substantially water impermeable barrier that can be used to direct and sweep away liquid or semi-liquid materials. Each bristle 53 can be located adjacent to one or more adjoining bristles 53 such that it creates a substantially continuous line of contact along a portion or an entire length of bristle 53. In an exemplary embodiment, bristle 53 contacts a plurality of neighboring bristles 53 located in front of, behind and/or next to bristle 53 to create a watertight boundary along a portion or entire length of bristle 53. Bristles 53 can further create a substantially continuous and secure contact with a surface so as to efficiently sweep away solid and/or liquids materials, leaving behind no or minimal residue. In one embodiment, the contact between one or more bristles 53 and a surface to be cleaned can allow a liquid to run around the tips 57 of a group of bristles 53. In another embodiment, the contact between one or more bristles 53 and a surface to be cleaned can entirely block the flow or seepage of a liquid between a group of bristles 53.

Figure 7A:
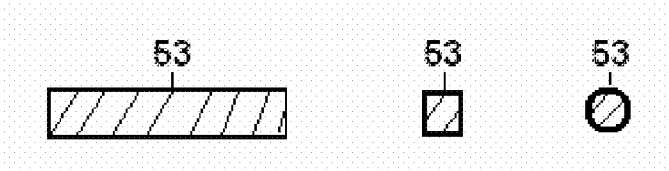
FIG. 7(*a*) is a schematic diagram showing a bottom view of two rows of bristles arranged in a linearly aligned configuration.
Figure 7B:
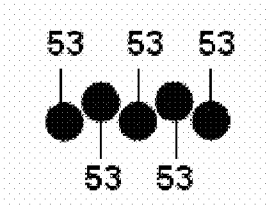
Figure 7C:
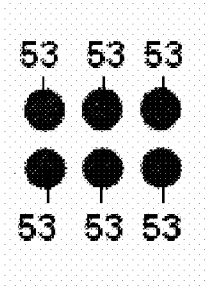

Bristles 53 can be arranged in any suitable uniform or random configuration that would enable operation as a conventional brush and/or squeegee. As shown in the exemplary embodiment of FIG. 7(*a*), bristles 53 are arranged in one or more rows wherein bristles 53 are linearly aligned. Alternatively, one or more rows of bristles 53 may be arranged in a staggered configuration such that bristles 53 are be offset relative to one another, as shown in FIG. 7(*b*). Such a staggered, offset arrangement can maximize the ability of brush 11 to catch and sweep away liquids. Bristles 53 can be arranged in one or more, preferably a plurality of, linearly aligned or staggered rows so as to create a self-reinforcing brush having the combined strength so as to be capable of removing ice and other materials that can be tightly bonded to a surface.

Bristles 53 can have any shape, size, configuration or material composition suitable for removing solid debris and/or liquid materials from a surface. Exemplary configurations are shown in FIG. 7(*c*). As best shown in FIGS. 1(*a*) and 5(*e*), bristle 53 includes a shaft 55 and a tip 57. Shaft 55 can have a cylindrical, rectangular, trapezoidal, wedge and/or flap like structure. Shaft 55 can also have any length, width, thickness or angular orientation. Shafts 55 of two or more bristles 53 can have different lengths, widths, thicknesses, angular orientations, or a combination thereof. This variation in the size and orientations in a group of bristles 53 enhances the ability of brush 11 to clean a multi-planar surface. For example, a set of bristles 53 can have a group of shorter and/or thicker bristles surrounded by a group of longer and/or thinner bristles. Bristles 53 can also be oriented perpendicular to, parallel to, or an acute angle with respect to a mounting surface of body 1. Shaft 55 can have a straight configuration along the length of bristle 53. Alternatively, shaft 55 can include two or more members that are angularly oriented relative to one another. Bristle 53 further includes a tip 57 that can be curved, rounded, beveled or otherwise blunted so as to be nonabrasive and avoid scratching, marring or otherwise damaging a surface. Tip 57 can also be configured to have a nonabrasive or minimally abrasive soft, fine point.

Bristles 53 can be synthesized from any material suitable for removing solid and/or liquid debris, including plastic materials and elastomeric polymers, such as rubber, or a combination thereof. Exemplary materials include thermoplastic elastomers.

In an exemplary embodiment, bristles 53 can be configured as a plurality of independently movable flaps. The flaps can be created by creating a plurality of slits in a continuous elastomeric polymer or plastic member. Shaft 55 can have a rectangular, trapezoidal or wedge like configuration, and tip 57 can be curved or beveled. Preferably, brush 11 can include one or more rows of these flap like bristles 53 capable of removing debris that is adhered to a surface. While the flap like bristles 53 can be independently moveable relative to one another so as to maneuver around and between objects, when a unidirectional force is applied to tips 57, bristles 53 are capable of creating a substantially continuous and water-tight wall that enables a user to capture, direct the movement of and sweep away liquid or semi-liquid materials.

Optionally, brush 11 can further include a set of or a plurality of conventional bristles that can be interspersed between bristles 53, located adjacent to bristles 53 and/or separated from bristles 53. In one embodiment, the conventional bristles can be located adjacent to bristles 53 of the present invention. Alternatively, bristles 53 can be located within a set of conventional bristles. In this embodiment, bristles 53 can be arranged in one or more rows within the set of conventional bristles.

Brush 11 can further include one or more optional squeegee members 59 that can operate to catch and remove any residual materials after bristles 53 have swept a surface. In an exemplary embodiment, one or more squeegee members 59 can be located adjacent to, preferably behind, bristles 53. Squeegee member 59 can have any conventional configuration that is capable of creating a water tight seal with and facilitates removal of liquid materials from a surface.

Scraper tool 100 further includes a handle 5 designed to facilitate application of force and debris removal. Handle 5 can be integrally formed with, mounted to or otherwise attached to any portion of body 1, preferably a central region spaced apart from outer edges 19. As shown in FIGS. 5(*a*)-5(*c*), handle 5 has an overall compact structure that is designed to fit within a user's hand. In one embodiment, handle 5 may be about 3 inches to about 5 inches in diameter, preferably about 3 to about 4 inches in diameter. Handle 5 can further have a domed or curved shape that is ergonomically designed to conform to a user's palm and fit within a user's hand.

One or more voids 61 can be positioned towards the front of handle 5 and can be configured to enable removal of debris trapped beneath handle 5 of scraper tool 100. As shown in FIGS. 5(*a*)-5(*c*), void 61 is defined in and disrupts the continuous domed curvature of handle 5. Void 61 can be configured as a through hole, hollow or an indentation in the exterior surface of handle 5 and can have any shape, including an accurate, oval, circular, or rectangular shape. Preferably, void 61 is a through hole that is sufficiently sized to facilitate a large removal of debris. As shown, void 61 is configured as a quarter spherical cut out in the font of handle 5. In one embodiment, void 61 has a length of about 1 inch to about 2 inches and a width of about 0.5 inches to about 1 inches. Alternatively, void 61 can have a diameter of about 1 inch to about 2 inches. The perimeter of void 61 is bounded by an edge 64 that can be curved and smoothed edge.

As shown in FIG. 5(*a*)-5(*c*), a ledge 62 adjoins a portion of void 61, extending from a portion of edge 64. In one embodiment, ledge 62 can have a substantially planer surface that extends into void 61. Ledge 62 can function to deflect debris rising from under scraper tool 100 away from a user's fingers and hand and/or provide a support surface for a user's finger tips.

Handle 5 can further have an elastic overmold 63, including a plurality of grip protrusions 65 and ribs 67, that facilitates gripping and enhances user comfort. The contours and grip protrusions 65 of overmold 63 prevent a user's hand from slipping from handle 5. In one embodiment, grip protrusions 65 can be configured as raised circular bumps or ridges covering a central and/or rear region of the domed structure of handle 5 intended to contact a user's palm. A plurality of grip protrusions 65 can be arranged in a circular, oval, diamond, or rectangular configuration. As shown in FIG. 5(*a*), two sets of ribs, each containing a plurality of vertically oriented ribs 67 arranged substantially perpendicular to ledge 62, can be positioned on opposite sides of handle 5 and void 61, adjoining main body 1 of scraper tool 100. In one embodiment, ribs 67 can function as a thumb rest and/or function to further deflect debris away from a user's hand and fingers.

As shown in FIG. 5(*a*)-5(*c*), elastic overmold 63 can substantially surround void 61 and define a hand and finger grip region. During use, a user's palm can be positioned over the central and/or rear of the domed elastic overmold region of handle 5, and the user's fingers can extend over void 61, gripping the front end of handle 5. Alternatively, void 61 can be sized and configured to comfortably receive about one to about four fingers, in order to facilitate gripping and application of force. The user's thumb and/or pinky can rest on the two set of ribs 67 positioned on opposite sides of the domed handle 5. As best shown in FIG. 5(*c*), at least a portion of handle 5, preferably, the front of handle 5, is at least partially encircled and surrounded by interior wall 27, which functions as a shield to deflect and substantially prevent loosened debris from covering the user's fingers and hand during use.

The scraping tool of the present invention can be used for a wide variety of applications. In particular, scraping tool 100 can be particularly well suited to remove frost, snow and ice from a multi-planer or curved surface, such as the window shield of an automobile. Additionally, scraper tool 100 can effectively remove frost, snow, ice and other debris from various material surfaces, including glass and metal surfaces, without scoring, marring or otherwise damaging the surface being cleaned. Scraper tool 100 can further be particularly effective for cleaning hard to remove debris that is entrained in or otherwise adhered to a surface. For example, the scraper tool can be used to peel paint or adhesives from a surface.

These and various other advantages and features of novelty that characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

What is claimed is:

1. A hand held scraper for removing debris from a surface, wherein the hand held scraper comprises:

a body;

a handle attached to the body; and a plurality of cantilever abraders that are flexible and capable of independently moving relative to one another, wherein at least two of the cantilever abraders comprises:

a cantilever body hinged to and extending from the body; and a scraping member depending from an underside of the cantilever body, the scraping member having a scraping edge positioned on an end of the scraping member for scraping a surface;

wherein the scraping edge of at least one of the plurality of cantilever abraders overlaps with an adjacent cantilever abrader scraping edge so as to substantially prevent passage of debris therebetween.

2. The hand held scraper of claim 1, wherein at least two of the plurality of cantilever abraders further comprises a support flange that projects from a lower surface of the cantilever abraders and functions to reinforce the scraping edge, wherein a first support flange portion of a first cantilever abrader overlaps with a second support flange portion of an adjacent second cantilever abrader to substantially prevent passage of debris between the first and second adjacent cantilever abraders.

3. The hand held scraper of claim 1, wherein the plurality of cantilever abraders are arranged along a perimeter of a front portion of the body.

4. The hand held scraper of claim 1, wherein the plurality of cantilever abraders are positioned adjacent to one another and form an arrow shaped configuration.

5. The hand held scraper of claim 1, wherein a first surface of at least one cantilever abrader nests with a second surface of an adjacent cantilever abrader.

6. The hand held scraper of claim 1, further comprising a plurality of scraper projections positioned adjacent to the plurality of cantilever abraders, wherein the scraper projections extend from a lower surface of the body.

7. The hand held scraper of claim 6, wherein a first scraper projection intersects a second adjacent scraper projection.

8. The hand held scraper of claim 6, wherein the plurality of scraper projections substantially covers an area of the lower surface selected from the group consisting of a rear region of the lower surface, a middle region of the lower surface, and a combination thereof.

9. The hand held scraper of claim 6, wherein the cantilever abraders and the scraper projections substantially covers the entire lower surface.

10. The hand held scraper of claim 1, further comprising a shield attached to the body and positioned in front of the handle, wherein the shield comprises a surface capable of deflecting debris away from the handle.

11. The hand held scraper of claim 10, wherein the shield and handle define a through hole in the body sized to facilitate the removal of debris.

12. The hand held scraper of claim 1, further comprising a notch formed on a perimeter of the body, wherein the notch is configured and adapted to receive a windshield wiper blade.

13. The hand held scraper of claim 1, further comprising a set of flexible bristles mounted to the body, wherein the bristles are collectively arranged to form a substantially water impermeable barrier.

14. A hand held scraper for removing debris from a surface, wherein the hand held scraper comprises:

a body;

a handle attached to the body; and a plurality of cantilever abraders that are flexible and capable of independently moving relative to one another, wherein at least one of said cantilever abraders comprises:

a cantilever body hinged to and extending from the body;

a scraping member depending from an underside of the cantilever body, the scraping member having a scraping edge positioned on an end of the scraping member for scraping a surface; and two support flanges connected to the scraping member that reinforce the scraping edge.

15. The hand held scraper of claim 14, wherein at least one of the cantilever abraders has a displacement range up to about 0.375 inches.

16. The hand held scraper of claim 14, further comprising a plurality of scraper projections positioned adjacent to the plurality of cantilever abraders, wherein each of the plurality of scraper projections extends downwards from a lower surface of the body.

17. The hand held scraper of claim 16, wherein a first scraper projection intersects an adjacent second scraper projection.

18. The hand held scraper of claim 14, further comprising a shield attached to the body and positioned in front of the handle, wherein the shield comprises a surface capable of deflecting debris away from the handle.

19. The hand held scraper of claim 14, further comprising a notch formed on a perimeter of the body, wherein the notch is configured and adapted to receive a windshield wiper blade.

20. The hand held scraper of claim 14, further comprising a set of flexible bristles mounted to the body, wherein the bristles are collectively arranged to form a substantially water impermeable barrier.

21. A hand held ice scraper for removing ice from a surface, the ice scraper comprising:

a body;

a dome-shaped handle formed integrally with the body;

a plurality of cantilever abraders that are flexible and capable of independently moving relative to one another, the cantilever abraders disposed at a front end of the body forward of the dome-shaped handle, each cantilever abrader comprising a cantilever finger extending from and hinged to the body and a scraping member depending from an underside of the cantilever finger, the scraping member having a scraping edge positioned on an end of the scraping member for scraping the surface, whereby the cantilever abraders will deflect upward due to the resistive pressure from the surface against which the scraping edges are pressed; and a plurality of non-cantilevered abraders each comprising a scraping member having a scraping edge depending from an underside of the body and positioned rearward of the plurality of cantilever abraders, at least some of the non-cantilevered abraders being positioned to the side of the dome-shaped handle.

* * * * *